US010112735B2

(12) United States Patent
Pippin

(10) Patent No.: US 10,112,735 B2
(45) Date of Patent: Oct. 30, 2018

(54) PACKAGE UNBUNDLING SYSTEM

(75) Inventor: James M. Pippin, Keller, TX (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 2093 days.

(21) Appl. No.: 13/277,565

(22) Filed: Oct. 20, 2011

(65) Prior Publication Data

US 2012/0096818 A1 Apr. 26, 2012

Related U.S. Application Data

(60) Provisional application No. 61/405,280, filed on Oct. 21, 2010.

(51) Int. Cl.

*B65B 43/00* (2006.01)
*B65B 69/00* (2006.01)
*B65B 65/00* (2006.01)

(52) U.S. Cl.

CPC ..... *B65B 69/00* (2013.01); *B65B 65/003* (2013.01); *B65B 69/0025* (2013.01)

(58) Field of Classification Search

CPC ..... B65B 69/00; B65B 43/00; B65B 57/00; B65B 57/04; B65B 69/0025; B65B 65/003; B67B 7/44; B65G 39/125

USPC ... 53/492, 381.1, 381.2, 534, 249, 391, 500; 414/411, 900; 382/101; 209/584

See application file for complete search history.

(56) References Cited

U.S. PATENT DOCUMENTS 3,362,523 A * 1/1968 Stone ..... B65G 39/125 198/826
4,207,720 A * 6/1980 Tolasch ..... A24C 5/354 221/200
4,507,040 A * 3/1985 Baese ..... A24C 5/35 131/283
4,541,520 A * 9/1985 Greenlee, III ..... 198/370.1
4,550,551 A * 11/1985 DeSantis ..... 53/534
4,569,183 A * 2/1986 DeSantis ..... 53/534
4,734,643 A * 3/1988 Bubenik et al. ..... 324/232
4,776,146 A * 10/1988 Whitehouse ..... 53/58
4,785,611 A * 11/1988 Hasenbalg ..... 53/536
4,927,133 A * 5/1990 Evans ..... 271/225
5,212,621 A * 5/1993 Panter ..... F16P 3/12 192/131 R
5,318,399 A * 6/1994 Marom ..... 414/412
5,454,688 A * 10/1995 Pippin ..... 414/797.9
5,476,035 A * 12/1995 Florindez ..... 99/443 C
5,477,663 A * 12/1995 Smith et al. ..... 53/475
5,615,993 A * 4/1997 Tanaka ..... 414/810
5,768,139 A * 6/1998 Pippin et al. ..... 700/216
5,813,199 A * 9/1998 Temburg ..... 53/492
5,983,601 A * 11/1999 Blanch et al. ..... 53/430
6,065,390 A * 5/2000 Florindez ..... 99/334

(Continued)

*Primary Examiner* — Hemant M Desai
*Assistant Examiner* — Eduardo R Ferrero

(57) ABSTRACT

Methods and tools for unbundling polywrapped packages. An automatic unbundling system includes an input unit configured to receive a polywrapped bundle that includes a plurality of items and a conveyor system configured to transport the bundle. The automatic unbundling system includes an automatic unwrapping machine configured to receive the bundle from the conveyor system and unwrap the bundle. The automatic unbundling system can include a loose stack accumulator configured to straighten the unwrapped plurality of items.

18 Claims, 5 Drawing Sheets

(56) References Cited

U.S. PATENT DOCUMENTS 6,401,936 B1 * 6/2002 Isaacs et al. ..... 209/656
6,412,655 B1 * 7/2002 Stuetzel ..... A47K 10/36 221/13
6,438,928 B1 * 8/2002 Huang et al. ..... 53/473
6,471,044 B1 * 10/2002 Isaacs et al. ..... 198/809
7,475,520 B2 * 1/2009 Swider ..... B07C 3/008 198/463.3
7,549,274 B2 * 6/2009 Fraser ..... 53/492
7,553,119 B2 * 6/2009 Good et al. ..... 414/331.08
7,963,086 B2 * 6/2011 Porter et al. ..... 53/381.2
8,261,515 B2 * 9/2012 Stemmle ..... B07C 3/008 206/509
8,374,398 B2 * 2/2013 Spitzig et al. ..... 382/112
2001/0030102 A1 * 10/2001 Woltjer et al. ..... 198/388
2002/0134056 A1 * 9/2002 Dimario et al. ..... 53/473
2003/0038065 A1 * 2/2003 Pippin et al. ..... 209/584
2004/0139692 A1 * 7/2004 Jacobsen et al. ..... 53/55
2004/0194428 A1 * 10/2004 Close et al. ..... 53/381.2
2005/0183402 A1 * 8/2005 Ball ..... 53/571
2005/0208188 A1 * 9/2005 Garwood ..... 426/392
2005/0247607 A1 * 11/2005 Knobel ..... B25J 9/0093 209/656
2006/0180521 A1 * 8/2006 Edmonds ..... B07C 3/00 209/584
2007/0017855 A1 * 1/2007 Pippin ..... 209/584
2007/0084764 A1 * 4/2007 Benninger ..... B07C 3/008 209/584
2007/0110277 A1 * 5/2007 Hayduchok et al. ..... 382/101
2007/0131593 A1 * 6/2007 Burns ..... B07C 1/02 209/584
2008/0011583 A1 * 1/2008 Beck ..... B65G 39/125 198/586
2008/0011653 A1 * 1/2008 Stemmle ..... B07C 3/00 209/584
2008/0027986 A1 * 1/2008 Stemmle ..... B07C 3/00
2008/0192978 A1 * 8/2008 Rundle et al. ..... 382/101
2009/0028383 A1 * 1/2009 Bayer ..... 382/101
2009/0038998 A1 * 2/2009 Henkel et al. ..... 209/589
2009/0113853 A1 * 5/2009 Porter et al. ..... 53/492
2009/0288996 A1 * 11/2009 Shafer ..... 209/546
2010/0145504 A1 * 6/2010 Redford et al. ..... 700/227
2012/0096818 A1 * 4/2012 Pippin ..... 53/492

* cited by examiner

PACKAGE UNBUNDLING SYSTEM

CROSS-REFERENCE TO OTHER APPLICATIONS

This application claims the benefit of the filing date of U.S. Provisional Patent Application 61/405,280, filed Oct. 21, 2010, which is hereby incorporated by reference.

TECHNICAL FIELD

The present disclosure is directed, in general, to machines and methods for opening wrapped bundles.

BACKGROUND OF THE DISCLOSURE

Improved bundle opening systems are desirable,

SUMMARY OF THE DISCLOSURE

Various embodiments include methods and tools for unbundling polywrapped packages. An automatic unbundling system includes an input unit configured to receive a polywrapped bundle that includes a plurality of items and a conveyor system configured to transport the bundle, The automatic unbundling system includes an automatic unwrapping machine configured to receive the bundle from the conveyor system and unwrap the bundle. The automatic unbundling system can include a loose stack accumulator configured to straighten the unwrapped plurality of items.

The foregoing has outlined rather broadly the features and technical advantages of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiment disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

Figure 1:
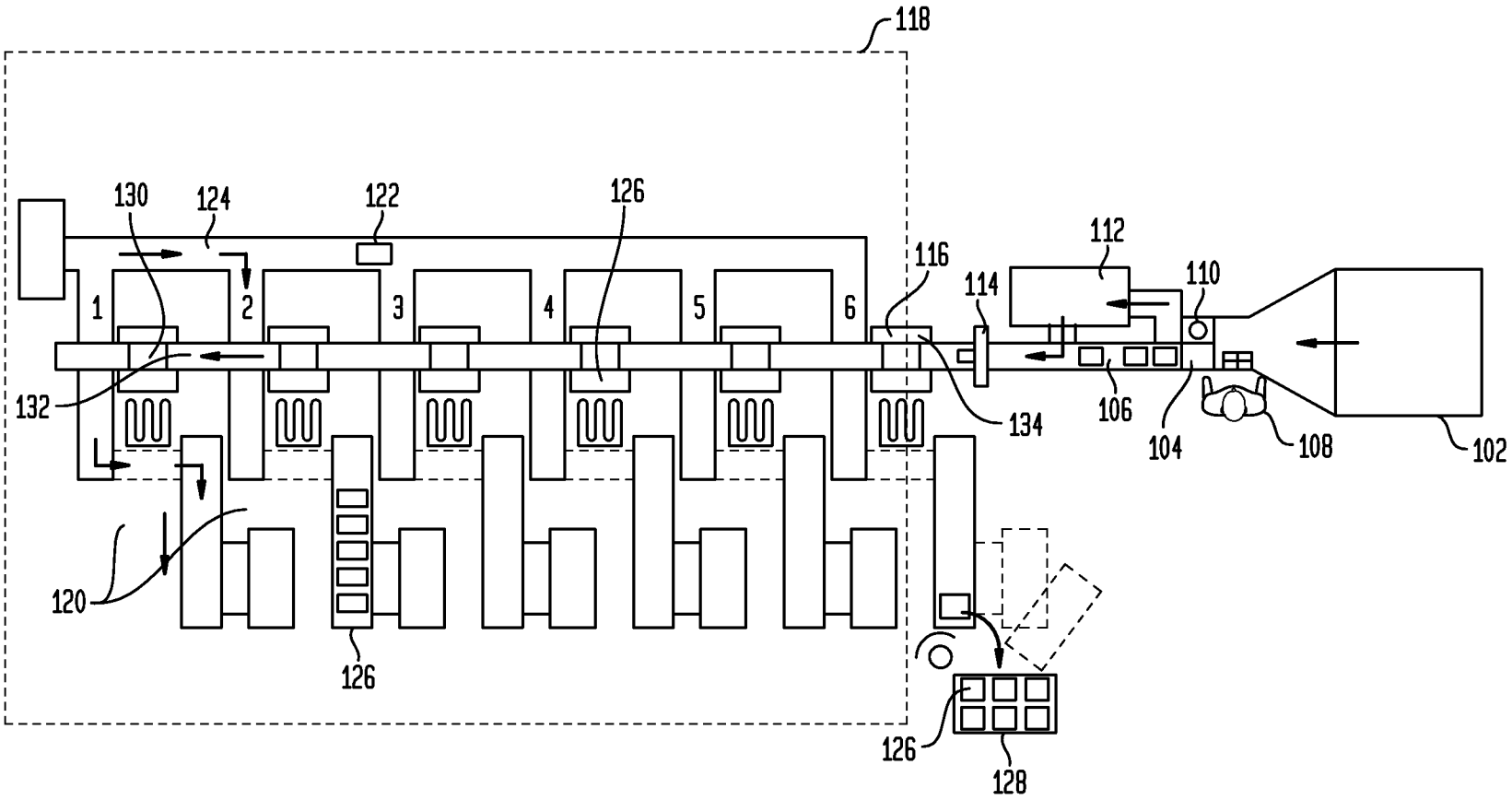
FIGS. 1-4 depict unbundling systems in accordance with disclosed embodiments.

FIGS. 1 through 5, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. The numerous innovative teachings of the present application will be described with reference to exemplary non-limiting embodiments.

Publishers typically shrinkwrap or strap completed magazines into bundles, Magazine bundles are trucked to the mail processing centers where each magazine must be sorted to a patron delivery point. In order to sort individual magazines, the bundles must be opened and prepared for feeding into a sorter. This process is called bundle preparation. A variety of bundle containments are possible but are generally either wrapped in film, strapped, or both. For strapping, mailers use a variety of techniques ranging from string or cords to, more typically, nylon or poly strap. For wrapping, polyfilm is generally preferred. To help prevent bundle breakage and protect magazines, some publishers both strap the bundle and wrap the strapped bundle with polyfilm.

As used herein, "poly film" or "polyfilm" refers to polyurethane, polyolefin, polythene, polyethene, polyethylene, poly(methylene), or similar thermoplastic films that can be used for wrapping bundles, packages, and other items. "Polywrapped" or "poly wrapped" refers to a package or bundle wrapped wholly or partially in a film such as a polyfilm. "Strapped" refers to a package or bundle that is tied using string, cords, nylon or poly straps, or otherwise. A "bundle" refers to a collection of items transferred together, that can be wrapped, strapped, or loose, and may include other packaging.

Unbundling polywrapped magazine bundles are significantly more time consuming and labor-intensive than strapped-only bundles. Various methods of automatic bundle destrapping are known, but no similar automatic bundle unwrapping systems are known in the art that can transport and process a wrapped bundle into a controlled stack or collection of the unwrapped contents.

Various embodiments include systems and methods that can perform such automatic bundle unwrapping functions, with or without also performing an unstrapping process. Systems disclosed herein include a cost-effective unbundling system that integrates auto unwrapping with automatic or semi-automatic destrapping. Various embodiments below can be implemented, in some case, using one or more bundle unwrapping machines such as those described by commonly-assigned United States Patent Publication 2009/

0282787, which is hereby incorporated by reference. That publication describes methods and machines for fully automatic opening and unwrapping of poly wrapped bundles.

Systems and methods disclosed herein improve unbundling efficiencies of all bundle containment types and provide economic and efficiency benefits to postal and delivery services throughout the world.

FIG. 1 depicts an unbundling system in accordance with disclosed embodiments. The structure and operation of this embodiment are described together.

The system receives bundles at an input unit 102. The input unit can be, for example, a chute from a loading dock or other location, a conveyor, or any other structure for receiving bundles. The bundles are polywrapped and may also be strapped. Other bundles may only be strapped.

In some cases, the input unit 102 can be a container dumper receptacle. In these cases, containers of bundles are brought to the unbundling system and positioned inside the container dumper. The operator activates the foot peddle style control switch and the container dumper rotates toward the bundle work station. Bundles empty from the container and flow towards the bundle work station.

The bundles, in this embodiment, are transferred to a bundle workstation 104. When bundles are described as "transferred", "transported", or otherwise moved, this can include moving them on a conveyor system such as conveyor 106, moving or sliding them on a low-friction table, or otherwise.

In some cases, portions or all of the conveyor 106, or any conveyor described herein, can be an angled or inclined stack conveyor. The angled stack conveyor can be angled approximately 30+ degrees from normal and have speed coupled/synchronized drive belts at right angles providing two sides of moving belt to support the loose stack at the face and edge. In this way, gravity and belt friction acting on two sides cradles the loose stack as it is conveyed. The open architecture of an angled stack conveyor allows free and clear image recognition of the bundle face without obstructions generally caused by misplaced straps or torn or marred polywrapping. The open conveyor architecture also facilitates operator intervention as may be required for detecting and culling compensated bundles, observing stack exceptions or for applications where manual tray filling is desired.

Various embodiments disclosed herein include bundle workstations. A bundle workstation can include different features in different embodiments. A bundle work station facilitates operator action, such as by an operator 108, as the operator performs various tasks. For example, these tasks can include taking an individual bundle, sliding it on a low friction table as the operator faces, edges, and sorts the bundle according bundle type (e.g., strap, wrap, and other).

Machinable polywrapped bundles can be placed onto an automation bundle input conveyor 110 where they are transported to an automatic bundle unwrapper such as bundle unwrapping machine 112. Machinable bundles which are both polywrapped and strapped can be placed on the automation bundle input conveyor 110 once the straps are cut by the operator 108 in embodiments where there is no automatic destrapper. In these cases, the bundle station operator 108 cuts the straps on strapped bundles and places the loose stack on the conveyor 106 for take away. Bundles contained by strings, rubber bands, or other exception techniques can also be cut by the bundle station operator 108 and the resulting unbundled stack is placed on the conveyor 106.

Manually unwrapping bundles requires many times the amount of operator time than sliding bundles onto a conveyor takeaway. Occasionally when the automation bundle queue is filled and awaiting takeaway, the operator may choose to open a few manual rejects and place them on the conveyor 106 for automatic takeaway. Bundles with strings or straps are prime candidates for working intermittently since they can be more quickly opened and placed on the conveyor 106. When the bundle mix contains a higher percentage of manual bundles than can be occasionally worked between automation waves, they will be cleared from the work station by sliding them down the manual exceptions chute and allowed to accumulate in a rolling cart. The time required to manually open and automatically process manual rejects can be determined by the volume and type reject bundles which accumulate in the reject cart.

The system automatically unwraps any polywrapped bundles at bundle unwrapping machine 112. Bundle unwrapping machine 112 receives polywrapped bundles at an input such as bundle input conveyor 110.

In some implementations, polywrapped bundles which were automation-qualified and prepared at the bundle work station 104 are automatically diverted from the conveyor 106 onto the bundle input conveyor 110. The bundle input conveyor 110 centers the varying size bundles prior to being clamped for the bundle opening and unwrapping process performed by bundle unwrapping machine 112. At bundle unwrapping machine 112, wrappers removed from the bundles are clamp extracted and dropped onto a dunnage takeaway conveyor. The dunnage takeaway conveyor moves the refuse to a collection container or other recycling receptacle. Loose unwrapped stacks coming from the bundle unwrapping machine 112 are clamp-transferred and moved to a stack transfer and merge module. Note that for simplicity of description, the loose, unwrapped items may be referred to as the "bundle", "unwrapped bundle", or similar.

In some embodiments, bundle unwrapping machine 112 can include or be connected to a stack transfer and merge unit. The transfer and merge unit is located along conveyor 106. Clamped unwrapped stacks coming from the bundle unwrapping machine 112 are positioned above the angled stack conveyor allowing stacks to flow unobstructed. Individually powered and controlled sections of the conveyor 106 close gaps between stacks and dampen the effects of pausing the stack flow ahead of the merge. Once a gap either presents itself or is caused through a controlled stop of the upstream conveyor sections, the merge unit tilts downward and onto the surface of the conveyor 106. For stack tilt down, the clamp action is used in combination with retractable base and forward edge belt plates. The belt plates arranged in an "L" arrangement support the stack to allow a rapid tilt action downward to the conveyor 106. Once the stack is in the "L" shaped cradle of angled conveyor 106, the clamp releases and the two belt plates withdraw. The action of withdrawing the belt plates cause the belts to withdraw with a peel away action relative to the stack surfaces. The peeling action of the belt surfaces cancels the relative motion between the stack surfaces and belt plates. Canceling relative motion minimizes disturbance of the loose stack.

In some implementations, the bundle input conveyor 110 can be inset below the workstation surface and start at the rear of the bundle work station 104. The operator faces and edges the bundle then slides those bundles which are automation-compatible onto the queuing section of the bundle conveyor. The bundle conveyor can be a low voltage/power belt-on-roller arrangement. The bundle conveyor inclines just beyond the bundle workstation 104, in some embodiments, and rises to the input conveyor level of the bundle unwrapping machine 112. Prior to the first divert, bundles are automatically measured to confirm automation size compatibility. If the bundle is above the maximum or below the minimum bundle size which the bundle unwrapping machine 112 is designed to handle, the bundle conveyor can bypass the right angle pusher divert and travels to the end of the bundle conveyor where it slides down a reject chute and into an awaiting cart. Qualified bundles are push-diverted onto the bundle input conveyor 110 of bundle unwrapping machine 112. The bundle input conveyor 110 of bundle unwrapping machine 112 elevation is located sufficiently above the stack output of the bundle unwrapping machine 112 and conveyor 106 to not obstruct workflow. Arranging the conveyor architecture in this way allows multiple unwrappers and/or destrappers to be placed alongside a common bundle and stack conveyor.

The de-strapped or unwrapped bundles are output or placed onto conveyor 106, Conveyor 106 can be an angled or slanted conveyor with a sidewall to keep an unwrapped or unstrapped bundle of items together during transport.

The system can transport the bundles to a bundle recognition and orientation unit 114. This unit can include a camera to image each of the bundles and can perform such functions as reading addresses and other indicia on the items of the bundle, determining the orientation of the items of the bundle, and determining such information as the address destination, size, fill level, and condition and condition of the items, referred to herein as "imaging information." In other embodiments, the bundle recognition and orientation unit 114 can include an assembly that re-orients the bundles so that they are facing the right way and are properly aligned.

The system can transport the unwrapped bundles to a retractable section 130 of conveyor 132 above a loose stack accumulator or tray. Retractable section 130 of conveyor 132 can selectively open, which results in a sort action when loose stacks drop into the loose stack accumulator 116 or optional tray 134 either which can receive, combine and stack successive loose stacks generated by the unwrapping, unstrapping, or manual unbundling processes. In some embodiments, the system can include multiple trays and loose stack accumulators, and can transport each of the unwrapped bundles to a respective loose stack accumulator or tray based on the orientation or other information determined by the bundle recognition and orientation unit 114.

The system can transport the bundles to a sorting system 118. Sorting system 118 includes one or more output lanes 120 into which the bundles can be sorted.

Empty trays 122 can be transported on an empty tray conveyor 124 to each of the output lanes 120. At each output lane 120, the bundles are deposited, according to a sort plan, into the appropriate tray, for example using an automatic tray loader. Filled trays 126 can then be loaded on a cart 128 for transport, delivery, or further processing.

In some cases, sorting system 118 can include manual tray stations, in these cases, stacks move on the conveyor 106 toward one or more manual tray filling stations, which can be used in place of or in addition to automatic tray loaders. One or more operators can be located at individual tray fill stations remove stacks from the conveyor 106 and place them in the tray below. Once the tray is filled, the operator can activate a proximity switch, causing the filled tray to index and simultaneously advance the next empty tray into the fill position.

Filled trays accumulate in run outs. When enough filled trays accumulate along the conveyor run-outs to fill one or more carts, an operator manually transfers the trays onto awaiting carts, or the system automatically does so. Mechanically assisted, fully-automatic cart loaders and/or an interconnecting tray conveyor can be used to connect the bundle sorting system 118 to a sorter for individual items, such as a flat sorter.

Figure 2:
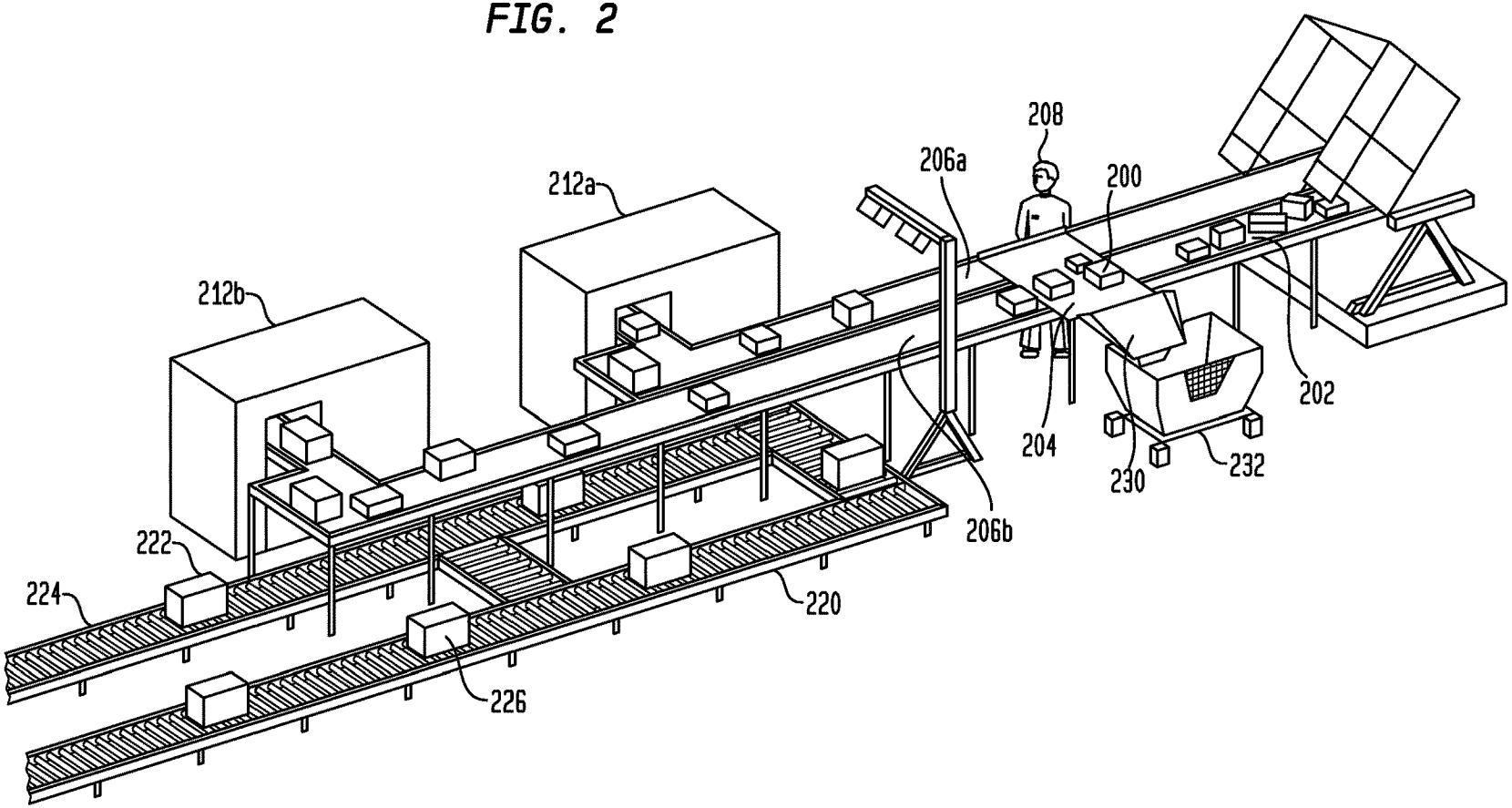

FIG. 2 depicts an unbundling system in accordance with disclosed embodiments. The structure and operation of this embodiment are described together.

Note that various elements of the exemplary embodiments described herein can be combined with each other, duplicated, or omitted depending on the requirements of the implementation. Note also that similar elements, components, or operations may be present in different ones of the specific examples described herein. Features that have been previously described in one example need not and may not be repeated in every example.

The system receives bundles at an input unit 202. The input unit can be, for example, a chute from a loading dock or other location, a conveyor, or any other structure for receiving bundles. The bundles are polywrapped, and may also be strapped. In some cases, the input unit 202 can be a container dumper receptacle.

The bundles 200, in this embodiment, are transferred to a bundle workstation 204. When bundles are described as "transferred", "transported", or otherwise moved, this can include moving them on a conveyor system such as conveyors 206*a* and 206*b*, moving or sliding them on a low-friction table, or otherwise.

Machinable polywrapped bundles can be placed onto an automation bundle input conveyor 206*a* where they are transported to an automatic bundle unwrapper such as bundle unwrapping machine 212*a*.

Machinable strapped bundles can be placed onto an automation bundle input conveyor 206*b* where they are transported to an automatic bundle unstrapper such as bundle unstrapping machine 212*b*. Bundle unstrapping machine 212*b* uses techniques known to those of skill in the art to automatically unstrap the bundles. Conveyors 206*a* and 206*b* can be different portions of a conveyor system.

Machinable bundles which are both polywrapped and strapped can be placed on the auto bundle conveyor 206*a* to be unwrapped by bundle unwrapping machine 212*a*, then transported on conveyor 206*b* to bundle unstrapping machine 212*b* to be unstrapped. Any straps or unprocessable material can also be cut by the bundle station operator 208 and the resulting unbundled stack is placed on the stack conveyor, or can be moved to exception/reject chute 230 and then to cart 232. The exception/reject chute 230 is used to move a bundle that cannot be automatically processed into a position for manual processing.

The system automatically unwraps any polywrapped bundles at bundle unwrapping machine 212*a* and unstraps them at bundle unstrapping machine 212*b*.

Bundle unwrapping machine 212*a* and bundle unstrapping machine 212*b*, in this example, automatically fill trays with the unwrapped/unstrapped bundle content. Empty trays 222 can be transported on an empty tray conveyor 224 to bundle unwrapping machine 212*a* and bundle unstrapping machine 212*b*, which deposits the contents in the tray. Filled trays 226 are then transported on output lanes 220 for further processing.

Figure 3:
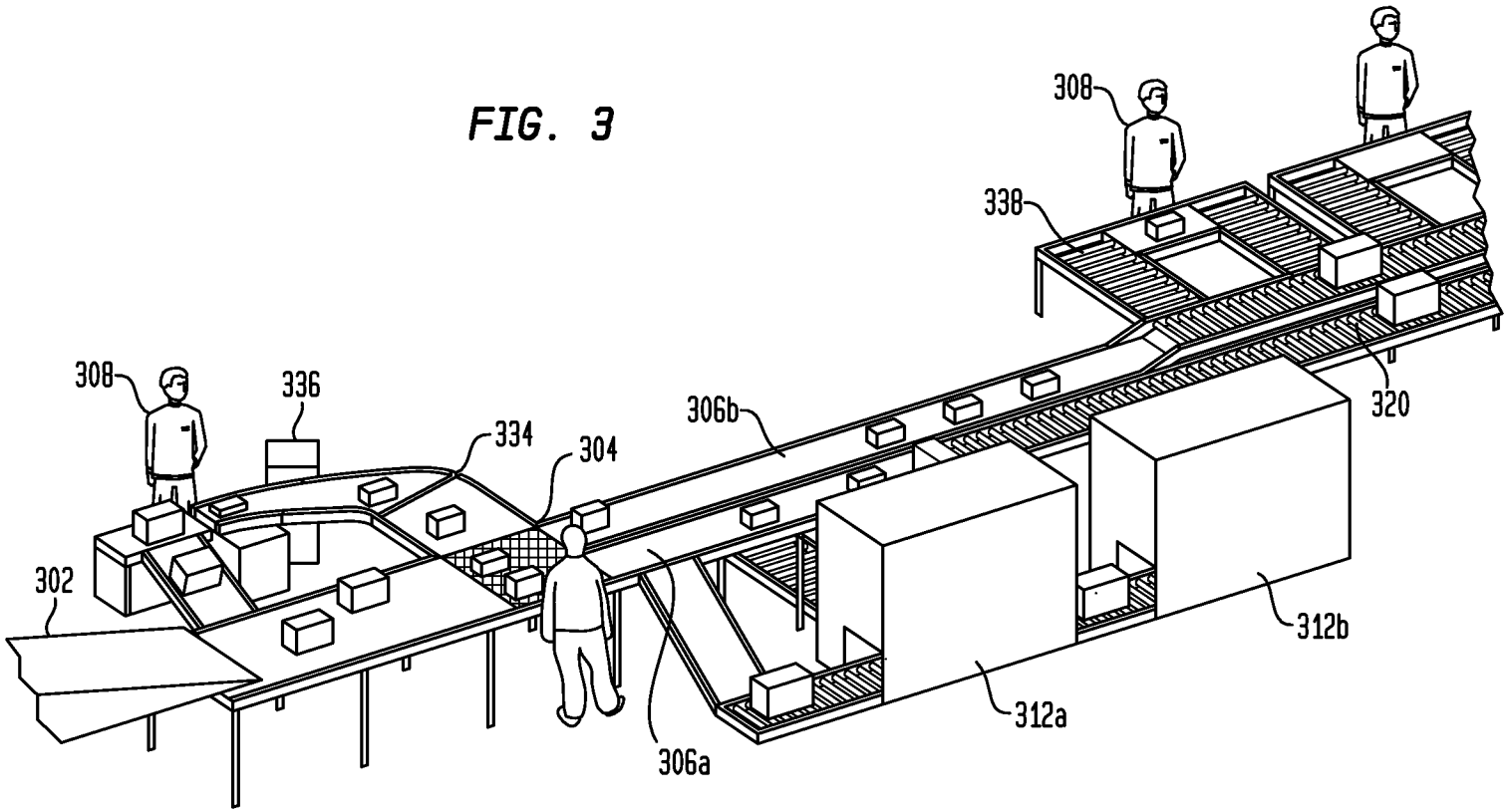

FIG. 3 depicts an unbundling system in accordance with disclosed embodiments. The structure and operation of this embodiment are described together.

The system receives bundles at an input unit 302. The input unit can be, for example, a chute from a loading dock or other location, a conveyor, or any other structure for receiving bundles. The bundles are polywrapped, and may also be strapped.

The bundles, in this embodiment, are transferred to a bundle workstation 304. When bundles are described as "transferred", "transported", or otherwise moved, this can include moving them on a conveyor system such as conveyors 306*a* and 306*b*, moving or sliding them on a low-friction table, or otherwise.

Some bundles may be moved to a takeaway conveyor 334 for manual unbundling at manual unbundling station 336 by an operator 308.

Machinable polywrapped bundles can be placed onto an automation bundle input conveyor 306*a* where they are transported to an automatic bundle unwrapper such as bundle unwrapping machine 312*a*.

Machinable strapped bundles can be placed onto an automation bundle input conveyor 306*b* where they are transported to an automatic bundle unstrapper such as bundle unstrapping machine 312*b*. Bundle unstrapping machine 312*b* uses techniques known to those of skill in the art to automatically unstrap the bundles.

Machinable bundles which are both polywrapped and strapped can be placed on the auto bundle conveyor 306*a* to be unwrapped by bundle unwrapping machine 312*a*, then transported on conveyor 306*b* to bundle unstrapping machine 312*b* to be unstrapped. The system automatically unwraps any polywrapped bundles at bundle unwrapping machine 312*a* and unstraps them at unstrapping machine 312*b*.

Bundle unwrapping machine 312*a* and bundle unstrapping machine 312*b*, in this example, send the unwrapped and unstrapped bundles down output lanes 320 for further processing.

Optionally, the unwrapped and unstrapped bundles can be sent to workstations 338 for operators 308 to perform any necessary stacking, straightening, or other manipulation of the unpackaged bundles so that they can be further processed.

Figure 4:
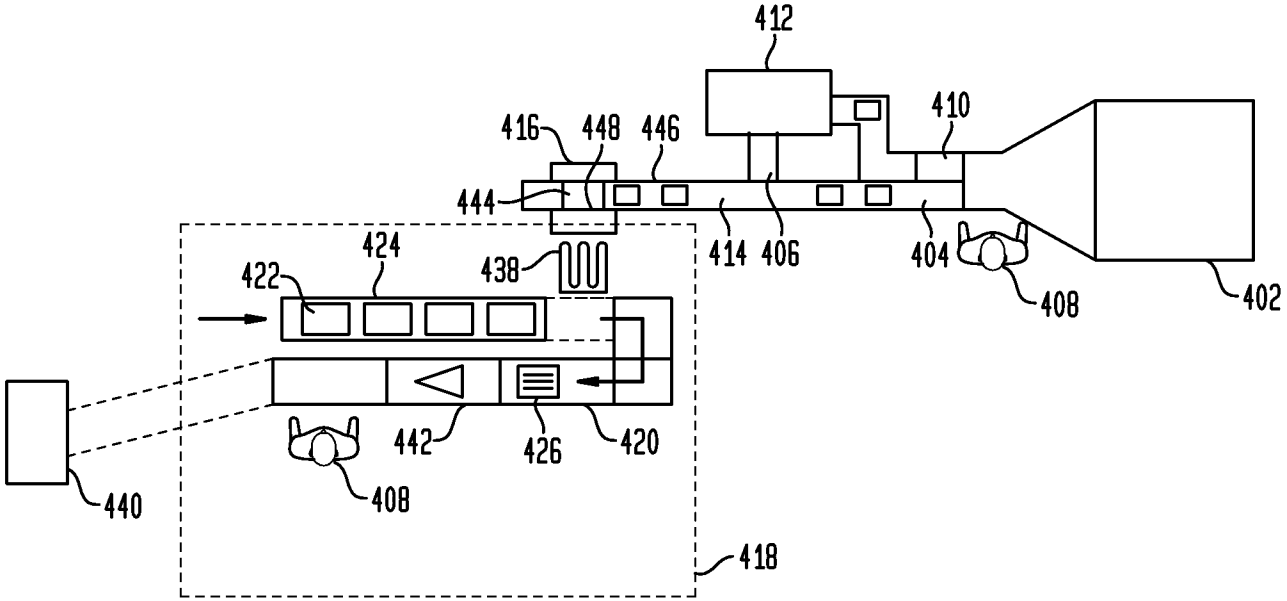

FIG. 4 depicts an unbundling system in accordance with disclosed embodiments. The structure and operation of this embodiment are described together.

The system receives bundles at an input unit 402. The input unit can be, for example, a chute from a loading dock or other location, a conveyor, or any other structure for receiving bundles. The bundles are polywrapped, and may also be strapped.

In some cases, the input unit 402 can be a container dumper receptacle. In these cases, containers of bundles are brought to the unbundling system and positioned inside the container dumper receptacle. The operator activates the foot peddle style control switch and the container dumper receptacle rotates toward the bundle work station. Bundles empty from the container and flow towards the bundle work station.

The bundles, in this embodiment, are transferred to a bundle workstation 404. When bundles are described as "transferred", "transported", or otherwise moved, this can include moving them on a conveyor system such as conveyor 406, moving or sliding them on a low-friction table, or otherwise. The "conveyor system" can include one or more connected or separate conveyor portions, each portion respectively acting as described herein.

Various embodiments disclosed herein include bundle workstations. A bundle workstation can include different features in different embodiments. A bundle work station facilitates operator action, such as by an operator 408, as the operator performs various tasks. For example, these tasks can include taking an individual bundle, sliding it on a low friction table as the operator faces, edges, and sorting the bundle according bundle type (e.g., strapped, wrapped, and other). Note that in various embodiments, the received bundles can be in a stream that has some mixture of strapped bundles, wrapped bundles, strapped, and wrapped bundles, and other bundles that may be loose or otherwise bound.

Machinable polywrapped bundles can be placed onto an automation bundle input conveyor 410 where they are transported to an automatic bundle unwrapper such as bundle unwrapping machine 412. Machinable bundles which are both polywrapped and strapped can be placed on the automation bundle input conveyor 410 once the straps are cut by the operator 408 in embodiments where there is no automatic destrapper. In these cases, the bundle station operator 408 cuts the straps on strapped bundles and places the loose stack on the stack conveyor 406 for take away. Bundles contained by strings, rubber bands or other exception techniques can also be cut by the bundle station operator 408 and the resulting unbundled stack is placed on the conveyor 406.

The system automatically unwraps any polywrapped bundles at bundle unwrapping machine 412. Bundle unwrapping machine receives polywrapped bundles at an input such as bundle input conveyor 410.

In some implementations, polywrapped bundles which were automation-qualified and prepared at the bundle work station 404 are automatically diverted from the bundle conveyor onto the bundle input conveyor 410. The bundle input conveyor 410 centers the varying size bundles prior to being clamped for the bundle opening and unwrapping process performed by bundle unwrapping machine 412. At bundle unwrapping machine 412, wrappers removed from the bundles are clamp extracted and dropped onto a dunnage takeaway conveyor. The dunnage takeaway conveyor moves the refuse to a collection container or other recycling receptacle. Loose unwrapped stacks coming from the bundle unwrapping machine 412 are clamp-transferred and moved to a stack transfer and merge module.

The de-strapped or unwrapped bundles are output or placed onto conveyor 406. Conveyor 406, like other conveyors in various embodiments, can be an angled or slanted conveyor with a sidewall to keep an unwrapped Or unstrapped bundle of items together during transport, as described herein. While part of the same conveyor system 406, not all portions of the conveyors herein need be connected to each other, and some portions may be flat while other portions are angled as described herein.

The system can transport the bundles to a bundle recognition and orientation unit 414 for processes as described above.

The system can transport the bundles to a retractable section 444 of conveyor 446 above a loose stack accumulator or optional tray. Retractable section 444 of conveyor 446 can selectively open which results in a sort action when loose stacks drop into the loose stack accumulator 416 or tray 448 which receives, combines and stacks successive loose stacks generated by the unwrapping, unstrapping, or manual unbundling processes.

The system can transport the bundles to a tray-filling system 418. Tray-filling system 418 includes one or more output lanes 420.

Empty trays 422 can be transported on an empty tray conveyor 424 to each of the output lanes 420. At each output lane 420, the bundles are deposited at location 438, into the appropriate tray, for example using an automatic tray loader. Filled trays 426 can then be transported to sorter 440 for further processing.

In some cases, tray-filling system 418 can includes manual tray stations 442. In these cases, stacks move on the conveyor 406 toward one or more manual tray filling stations, which can be used in place of or in addition to automatic tray loaders. One or more operators 408 can be located at individual tray fill stations to remove stacks from the conveyor 406 and place them in the tray below. Once the trays are filled, the operator can activate a proximity switch, causing the filled tray to index and simultaneously advance the next empty tray into the fill position.

Filled trays accumulate in run outs. When enough filled trays accumulate along the conveyor run-outs to fill one or more carts, an operator manually transfers the trays onto awaiting carts, or the system automatically does so. Mechanical assist, fully-automatic cart loaders and/or interconnecting tray conveyor can be used to connect the bundle sorting system 118 to a sorter for individual items, such as a flat sorter.

Figure 5:
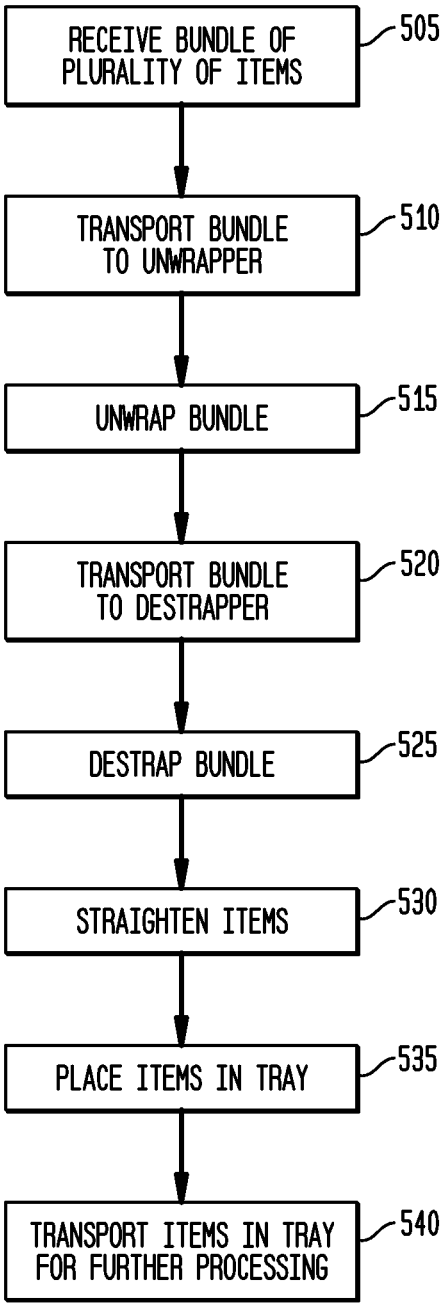
FIG. 5 depicts a flowchart of a process in accordance with disclosed embodiments.

FIG. 5 depicts a flowchart of a process in accordance with disclosed embodiments. In addition to the steps listed below, any other processes described herein can also optionally be included in processes performed by various embodiments of the unbundling systems disclosed herein.

The system receives a bundle at an input unit (step 505). The bundle has is polywrapped and is optionally strapped, and comprises a plurality of items.

The system transports the bundle to an automatic unwrapping machine (step 510).

The system automatically unwraps the bundle using the automatic unwrapping machine (step 515). This step can include disposing of the polyfilm wrapping.

The system can optionally transport the bundle to an automatic destrapping machine (step 520), if it is strapped, and automatically strap the bundle (step 525).

The system can automatically straighten or restack the unwrapped and unstrapped plurality of items (step 530). This step can be performed by a loose stack accumulator.

The system can place the plurality of items in a tray (step 535). The "tray", as used herein, can be any carrier capable of transporting the items as described.

The system can transport the items in the tray for further processing (step 540) Further processing can be, for example, sorting each of the plurality of items.

As described herein, various embodiments include an automatic unbundling system that includes an input unit configured to receive a polywrapped bundle that includes a plurality of items and a conveyor system configured to transport the bundle. The automatic unbundling system includes an automatic unwrapping machine configured to receive the bundle from the conveyor system and unwrap the bundle. The automatic unbundling system includes a loose stack accumulator configured to straighten the unwrapped plurality of items.

Various embodiments include an automatic unbundling system that has an input unit configured to receive polywrapped bundles each including a plurality of items. The system has a conveyor system configured to transport the polywrapped bundles. The system has an automatic unwrapping machine configured to receive each of the bundles from the conveyor system and unwrap each of the bundles. The conveyor system can then transport the unwrapped plurality of items away from the automatic unwrapping machine. The conveyor system can include a bundle recognition and orientation verification unit that images each plurality of unwrapped items to create respective imaging information, and the conveyor system can transport each plurality of unwrapped items into a selected destination, including a loose stack accumulator or tray, according to the respective imaging information.

Various embodiments include an automatic unbundling system that has an input unit configured to receive a combination of strapped bundles and polywrapped bundles, each including a plurality of items. The system includes a conveyor system configured to selectively transport the polywrapped bundles to an automatic unwrapping machine, to transport the strapped bundles to an automatic destrapping machine, and to transport each unwrapped or destrapped plurality of items away from the respective automatic unwrapping machine and automatic destrapping machine. The automatic unwrapping machine is configured to receive each of the polywrapped bundles from the conveyor system and unwrap each of the polywrapped bundles. The automatic destrapping machine is configured to receive each of the strapped bundles from the conveyor system and destrap each of the strapped bundles. The conveyor system can then transport each unwrapped or destrapped plurality of items to a respective destination determined by imaging information from the respective unwrapped or destrapped plurality of items. The conveyor system can selectively transport the polywrapped bundles and the strapped bundles according to a placement of each bundle on the conveyor system by an operator.

Various embodiments include a method. The method includes receiving a polywrapped bundle at an input unit. The bundle includes a plurality of items. The method includes transporting the bundle to an automatic unwrapping machine and automatically unwrapping the bundle using the automatic unwrapping machine. The method includes placing the unwrapped plurality of items in a tray.

Unless specifically described herein, no steps or components should be regarded as essential or necessary for inclusion in the claims below. Further, in various embodiments, the steps above can be performed concurrently, sequentially, in a different order, or omitted, unless specified otherwise. The various elements and components of the exemplary embodiments above can be combined in still further embodiments within the scope of the disclosure.

It is important to note that white the disclosure includes a description in the context of a fully functional system, those skilled in the art will appreciate that at least portions of the mechanism of the present disclosure are capable of being distributed in the form of a computer-executable instructions contained within a machine-usable, computer-usable, or computer-readable medium in any of a variety of forms to cause a system to perform processes as disclosed herein, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs). In particular, computer readable mediums can include transitory and non-transitory mediums, unless otherwise limited in the claims appended hereto.

Although an exemplary embodiment of the present disclosure has been described in detail, those skilled in the art will understand that various changes, substitutions, variations, and improvements disclosed herein may be made without departing from the spirit and scope of the disclosure in its broadest form. In the processes described above, various steps may be performed sequentially, concurrently, in a different order, or omitted, unless specifically described otherwise.

None of the description in the present application should be read as implying that any particular element, step, or function is an essential element which must be included in the claim scope: the scope of patented subject matter is defined only by the allowed claims. Moreover, none of these claims are intended to invoke paragraph six of 35 USC§ 112 unless the exact words "means for" are followed by a participle.

What is claimed is:

1. An automatic unbundling system, comprising:

an input unit configured to receive polywrapped bundles each including a plurality of items;

a conveyor system configured to transport the polywrapped bundles;

an automatic unwrapping machine configured to receive each of the bundles from the conveyor system and unwrap each of the bundles, including centering and clamping each bundle, wherein the conveyor system then transports the unwrapped plurality of items away from the automatic unwrapping machine; and a loose stack accumulator configured to receive, combine, and stack the unwrapped plurality of items from successive bundles.

2. The automatic unbundling system of claim 1, wherein the conveyor system includes a bundle recognition and orientation verification unit that images each plurality of unwrapped items to create respective imaging information, and wherein the conveyor system transports each plurality of unwrapped items into either the loose stack accumulator or a tray according to the respective imaging information.

3. The automatic unbundling system of claim 2, further comprising at least one output lane that transports the plurality of items in the tray for further processing.

4. The automatic unbundling system of claim 3, wherein the further processing includes sorting each of the plurality of items.

5. The automatic unbundling system of claim 1, further comprising a tray-filling system that places the unwrapped plurality of items in a tray.

6. The automatic unbundling system of claim 1, further comprising an automatic destrapping machine that automatically removes at least one strap from the bundle.

7. The automatic unbundling system of claim 6, wherein the bundle is unwrapped before the at least one strap is removed from the bundle.

8. The automatic unbundling system of claim 6, wherein different portions of the conveyor system transport the bundle to the automatic unwrapping machine and the automatic destrapping machine.

9. The automatic unbundling system of claim 1, further comprising at least one bundle workstation where an operator can manually remove at least one strap from the bundle.

10. The automatic unbundling system of claim 1, further comprising at least one bundle workstation where an operator can face, edge, or sort the bundle.

11. The automatic unbundling system of claim 1, further comprising at least one manual tray filling station where an operator can move the unwrapped plurality of items to a tray.

12. The automatic unbundling system of claim 11, wherein the manual tray filling station includes a proximity switch that, when activated, causes the automatic unbundling system to index a filled tray and advance an empty tray into a fill position.

13. The automatic unbundling system of claim 1, further comprising an exception/reject chute that moves bundles that cannot be automatically processed into a position for manual processing.

14. An automatic unbundling system, comprising:

an input unit configured to receive polywrapped bundles each including a plurality of items, wherein the input unit is a container dumper receptacle;

a conveyor system configured to transport the polywrapped bundles;

an automatic unwrapping machine configured to receive each of the bundles from the conveyor system and unwrap each of the bundles, wherein the conveyor system then transports the unwrapped plurality of items away from the automatic unwrapping machine; and a loose stack accumulator configured to receive, combine, and stack the unwrapped plurality of items from successive bundles.

15. An automatic unbundling system, comprising:

an input unit configured to receive a combination of strapped bundles and polywrapped bundles, each including a plurality of items;

a conveyor system configured to selectively transport the polywrapped bundles to an automatic unwrapping machine and to transport the strapped bundles to an automatic destrapping machine, and configured to transport each unwrapped or destrapped plurality of items away from the respective automatic unwrapping machine and automatic destrapping machine, the conveyor system further configured to transport each unwrapped or destrapped plurality of items to a loose stack accumulator, wherein the automatic unwrapping machine is configured to receive each of the polywrapped bundles from the conveyor system and unwrap each of the polywrapped bundles, including centering and clamping each bundle, wherein the automatic destrapping machine is configured to receive each of the strapped bundles from the conveyor system and destrap each of the strapped bundles, wherein the loose stack accumulator is configured to receive, combine, and stack the unwrapped or destrapped plurality of items from successive bundles, and wherein the conveyor system transports each unwrapped or destrapped plurality of items to a respective destination determined by imaging information from the respective unwrapped or destrapped plurality of items.

16. The automatic unbundling system of claim 15, wherein the conveyor system selectively transports the polywrapped bundles and the strapped bundles according to a placement of each bundle on the conveyor system by an operator.

17. A method, comprising:

receiving a polywrapped bundle at an input unit, the bundle including a plurality of items;

transporting the bundle to an automatic unwrapping machine;

automatically unwrapping the bundle using the automatic unwrapping machine, including centering and clamping each bundle;

transporting the unwrapped plurality of items on a conveyor;

receiving, combining, and stacking the unwrapped plurality of items from successive bundles using a loose stack accumulator; and placing the unwrapped plurality of items in a tray.

18. The method of claim 17, further comprising destrapping the bundle using an automatic destrapping machine.

* * * * *